US009044847B2

(12) United States Patent
Kohlschmied et al.

(10) Patent No.: US 9,044,847 B2
(45) Date of Patent: Jun. 2, 2015

(54) POWER TOOL AND CONTROL METHOD

(75) Inventors: Frank Kohlschmied, Munich (DE); Christian Daubner, Mammendorf (DE); Markus Hartmann, Mauerstetten (DE)

(73) Assignee: Hilti Aktiengesellschaft, Schaan (LI)

( * ) Notice: Subject to any disclaimer, the term of this patent is extended or adjusted under 35 U.S.C. 154(b) by 712 days.

(21) Appl. No.: 13/156,592

(22) Filed: Jun. 9, 2011

(65) Prior Publication Data

US 2011/0303429 A1 Dec. 15, 2011

(30) Foreign Application Priority Data

Jun. 10, 2010 (DE) ..... 10 2010 029 915

(51) Int. Cl.

*B25D 9/16* (2006.01)
*B25D 11/00* (2006.01)
*B25D 17/06* (2006.01)

(52) U.S. Cl.

CPC ..... *B25D 11/005* (2013.01); *B25D 17/06* (2013.01); *B25D 2211/003* (2013.01); *B25D 2217/0015* (2013.01); *B25D 2250/035* (2013.01); *B25D 2250/131* (2013.01); *B25D 2250/365* (2013.01)

(58) Field of Classification Search

CPC ..... B25D 17/06; B25D 2250/035; B25D 2250/365; B25D 11/005; B25D 2211/068; B25D 2217/0015

USPC ..... 173/212, 112, 200, 201, 114, 109, 14

See application file for complete search history.

(56) References Cited

U.S. PATENT DOCUMENTS

| | | | | | |
|---|---|---|---|---|---|
| 2,521,248 | A | * | 9/1950 | Parker | 277/436 |
| 3,067,584 | A | * | 12/1962 | Atkinson | 92/84 |
| 4,068,727 | A | * | 1/1978 | Andersson et al. | 173/1 |
| 4,355,564 | A | * | 10/1982 | Gidlund | 91/217 |
| 4,624,325 | A | * | 11/1986 | Steiner | 173/212 |
| 4,932,479 | A | * | 6/1990 | Pyatov | 173/14 |
| 5,111,890 | A | * | 5/1992 | Ranger et al. | 173/104 |
| 5,775,440 | A | * | 7/1998 | Shinma | 173/109 |
| 5,873,418 | A | * | 2/1999 | Arakawa et al. | 173/212 |

(Continued)

FOREIGN PATENT DOCUMENTS

| | | | |
|---|---|---|---|
| DE | 38 26 213 | A1 | 2/1990 |
| DE | 10 2007 000 081 | A1 | 8/2008 |

(Continued)

OTHER PUBLICATIONS

German Search Report, dated Dec. 20, 2012, 5 pages.

(Continued)

*Primary Examiner* — Andrew M Tecco

(74) *Attorney, Agent, or Firm* — Crowell & Moring LLP

(57) ABSTRACT

A power tool and control method is disclosed. The power tool has a striker, which is guided along an axis parallel to an impact direction. A pneumatic chamber has a volume which varies with a movement of the striker along the axis. A valve device that is actuatable depending upon the movement direction of the striker connects the pneumatic chamber with an air reservoir. The valve device is actuated to open in the case of a movement of the striker in the impact direction and in the case of a movement of the striker against the impact direction is actuated to throttle or close. The throttled or closed valve device restricts an air flow flowing through it to a maximum of one tenth of the value as compared to the air flow in an opened position.

11 Claims, 10 Drawing Sheets

(56) References Cited

U.S. PATENT DOCUMENTS

| | | | | |
|---|---|---|---|---|
| 6,227,309 | B1 * | 5/2001 | Henke et al. | 173/201 |
| 2007/0039749 | A1 * | 2/2007 | Aoki | 173/201 |
| 2008/0202782 | A1 | 8/2008 | Hartmann et al. | |

FOREIGN PATENT DOCUMENTS

| | | | |
|---|---|---|---|
| EP | 0 017 635 | A1 | 10/1980 |
| EP | 0 133 161 | A1 | 2/1985 |
| EP | 0 759 341 | A2 | 2/1997 |
| EP | 1 967 328 | A2 | 9/2008 |
| GB | 2 458 523 | A | 9/2009 |

OTHER PUBLICATIONS

U.S. Patent Application, "Power Tool", filed Jun. 9, 2011, Inventor Markus Hartmann, et al.

European Search Report, dated Oct. 14, 2011, 8 pages.

* cited by examiner

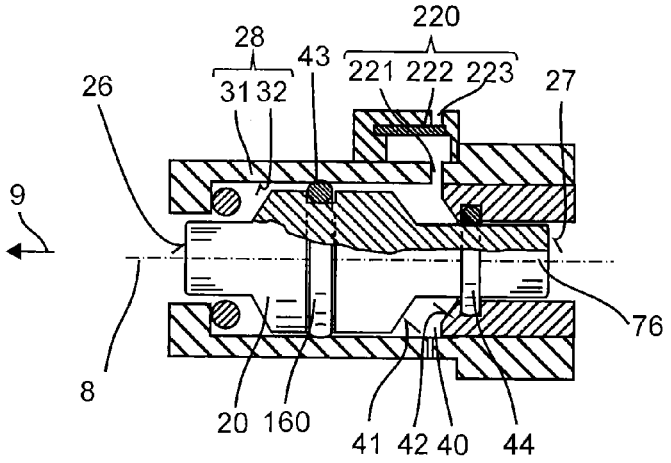
Fig. 24
Fig. 25
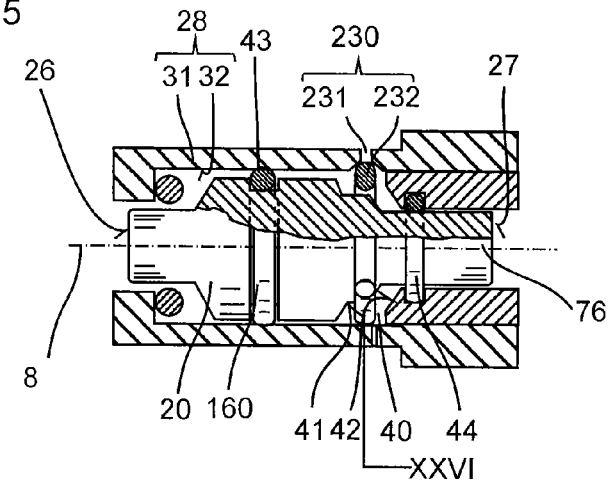
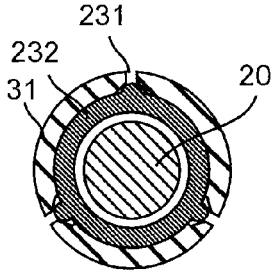
Fig. 26
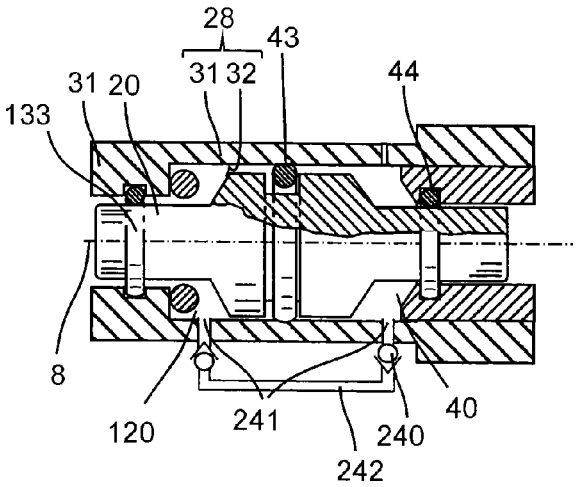
Fig. 27

POWER TOOL AND CONTROL METHOD

This application claims the priority of German Patent Document No. 10 2010 029 915.4, filed Jun. 10, 2010, the disclosure of which is expressly incorporated by reference herein.

BACKGROUND AND SUMMARY OF THE INVENTION

The present invention relates to a power tool, in particular a hand-operated chiseling power tool and a control method for the power tool.

In the case of hand-held chiseling power tools, chiseling action is supposed to be suspended when a chisel is lifted off a workpiece. In the case of striking mechanisms that operate pneumatically, a pneumatic spring can be deactivated by means of additional ventilation openings, which are only opened if the chisel is disengaged. A striker, also called an intermediate striking device or anvil, is supposed to remain away from the ventilation openings for this purpose after an empty impact. However, this is not the case to some extent due to the rebound of the striker on a forward limit stop.

A power tool according to the invention has a striker, which is guided along an axis parallel to an impact direction. A pneumatic chamber has a volume which varies with a movement of the striker along the axis. A valve device that is actuatable depending upon the movement direction of the striker connects the pneumatic chamber with an air reservoir. The valve device is actuated to open in the case of a movement of the striker in the impact direction and in the case of a movement of the striker against the impact direction is actuated to throttle or close. The throttled or closed valve device restricts an air flow flowing through it to a maximum of one tenth of the value as compared to the air flow in an opened position.

The striker is an impact body or anvil that is moveable along an axis, which is arranged between a striking device of a pneumatic striking mechanism and a tool inserted into a tool receptacle.

The striker experiences a braking effect because of the closed pneumatic chamber when it slides back into the tool receptacle. In the case of a movement in the impact direction, the valve device makes a pressure equalization possible in the pneumatic chamber, which is why no braking effect occurs.

One embodiment provides that the volume of the pneumatic chamber is preferably increasing monotonically in the case of a movement of the striker in the impact direction and the valve device is open for an air flow into the pneumatic chamber and throttled or blocked for an air flow out of the pneumatic chamber. Another embodiment provides that the volume of the pneumatic chamber is, for example, decreasing monotonically in the case of a movement of the striker in the impact direction, and the valve device is throttled or blocked for an air flow into the pneumatic chamber and open for an air flow out of the pneumatic chamber. The air reservoir may be a further pneumatic chamber, whose volume is, for example, decreasing monotonically in the case of a movement of the striker in the impact direction and the valve device connects the pneumatic chamber with the further pneumatic chamber. The actuated opened valve device may connect the pneumatic chamber with the further pneumatic chamber in such a way that an air quantity escaping from the further pneumatic chamber flows into the pneumatic chamber. One or two pneumatic chambers may be provided, which compress or expand in the case of a movement in the impact direction depending upon their relative arrangement with respect to the striker. A valve device may be provided for each of the chambers or even in the case of two chambers these are connected via a common valve device.

One embodiment provides that the pneumatic chamber is closed by a guide for guiding the striker along the axis, the striker and two seals arranged offset from one another along the axis, e.g., in the radial direction, between the striker and the guide, wherein in a projection onto a plane perpendicular to the axis, the two seals do not overlap at least in sections.

One embodiment provides that the pneumatic chamber and the additional pneumatic chambers are closed by a guide for guiding the striker along the axis, the striker and three seals arranged offset from one another along the axis between the striker and the guide, wherein the respective adjacent seals in a projection onto a plane perpendicular to the axis do not overlap at least in sections. At least one of the seals may be formed by the valve device. An opening in the guide may be arranged between two adjacent seals, and the valve device connects the opening with the air reservoir or a further air reservoir. The valve device may be arranged outside of the guide.

One embodiment provides that the valve device is a valve device actuated by its own medium, which is actuated by an air flow into or out of the pneumatic chamber. An air flow keeps the valve device open when the airflow flows in the flow-through direction. An air pressure, which acts against the flow-through direction on the valve device, closes it. The valve device may include a check valve.

One embodiment has a throttle, which connects the pneumatic chamber with an air reservoir. An effective cross-sectional area of the pneumatic chamber, defined by the differential of the volume of the pneumatic chamber in the impact direction is greater than a hundred times a cross-sectional area of the throttle. The striker is moved parallel to the axis, whereby a volume change of the pneumatic chamber is produced proportional to the displacement along the axis and the effective cross-sectional area. The effective cross-sectional area can be determined by the mathematical operation of differentiation in the movement or impact direction. In the case of a cylindrical guide and a cylindrical striker, the effective cross-sectional area corresponds to the largest cross-sectional area perpendicular to the axis. The ratio of the effective cross-sectional area of the pneumatic chamber to the cross-sectional area of the throttle determines a relative flow speed of the air in the throttle related to the speed of the striker. Starting at this relative flow speed, the air can escape quickly enough from the pneumatic chamber without a drop in pressure developing with respect to the environment. It was recognized that an absolute speed of the air in the throttle cannot be exceeded. However, the throttle appears to block a limit value of the absolute speed. The ratio of a hundred times, preferably three-hundred times, is selected so that, in the case of a striker driven by the striking mechanism, the absolute speed of the air in the throttle is reached; in the case of a striker moved manually, the absolute speed is fallen short of considerably. As a result, the throttle blocks when the striker strikes, and opens when the striker is moved manually.

In one embodiment, the power tool has a pneumatic striking mechanism, which is arranged percussively with its impacting piston in the impact direction on the striker.

In the case of a control method according to the invention for the power tool, the valve device is opened if the striker moves in the impact direction, and the valve device is closed if the striker moves against the impact direction.

The following description explains the invention on the basis of exemplary embodiments and figures.

BRIEF DESCRIPTION OF THE DRAWINGS

FIG. 24 shows a striker brake with an external valve;

FIGS. 25 and 26 show a striker brake with an external valve;

FIG. 27 shows a striker brake with an external coupling valve;

DETAILED DESCRIPTION OF THE DRAWINGS

Unless otherwise indicated, the same or functionally equivalent elements are identified in the figures by the same reference numbers.

Figure 1:
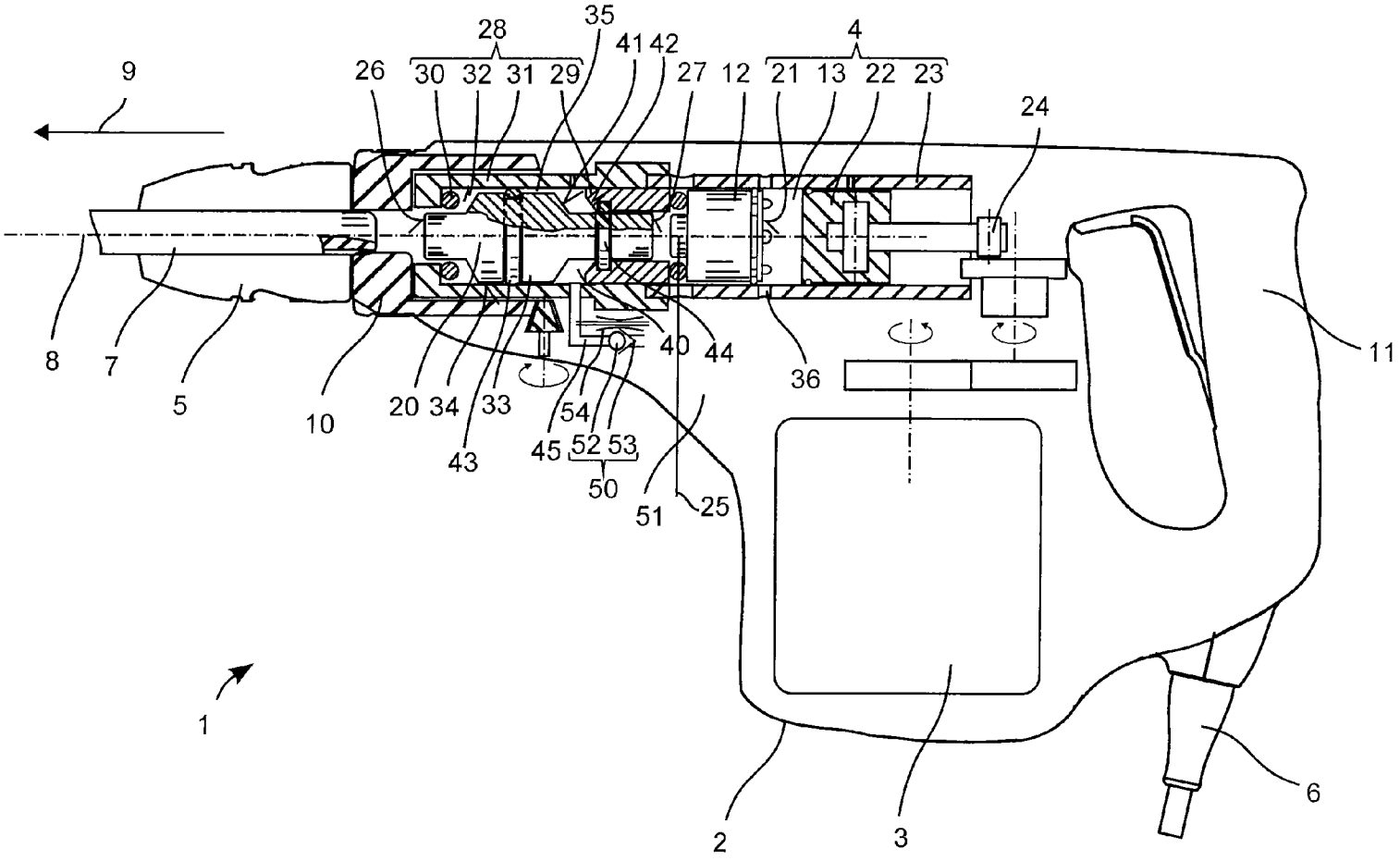
FIG. 1 illustrates a hand-held power tool with a pneumatic striking mechanism and a striker brake.

FIG. 1 shows a hammer drill 1 as an embodiment for a chiseling power tool. The hammer drill 1 has a machine housing 2, in which a motor 3 and a pneumatic striking mechanism 4 driven by the motor 3 are arranged, and a tool receptacle 5 is preferably fastened in a detachable manner. The motor 3 is an electric motor, for example, which is supplied with electricity by a cable-based power supply 6 or a chargeable battery system. The pneumatic striking mechanism 4 drives a tool 7 inserted into the tool receptacle 5, e.g., a boring tool or a chisel, away from the hammer drill 1 along an axis 8 in the impact direction 9 into a workpiece. The hammer drill 1 optionally has a rotary drive 10, which can rotate the tool 7 around the axis 8 in addition to the impacting movement. One or two hand grips 11 are fastened on the machine housing 2, which make it possible for a user to operate the hammer drill 1. A purely chiseling embodiment, e.g., a chisel hammer, differs from the hammer drill 1 essentially only by the lack of the rotary drive 10.

The pneumatic striking mechanism 4 depicted exemplarily has an impacting piston 12, which is induced by an excited pneumatic spring 13 to move forward, i.e., in the impact direction 9, along the axis 8. The impacting piston 12 hits a striker 20 and thereby releases a portion of its kinetic energy to the striker 20. Because of the recoil induced by the pneumatic spring 13, the impacting piston 12 moves backward, i.e., against the impact direction 9, until the compressed pneumatic spring 13 again drives the impacting piston 12 forward. The pneumatic spring 13 is formed by a pneumatic chamber, which is closed axially at the front by a rear face side 21 of the impacting piston 12 and axially at the rear by an exciter piston 22. In the radial direction, the pneumatic chamber can be closed circumferentially by an impacting tube 23, in which the impacting piston 12 and the exciter piston 22 are guided along the axis 8. In other designs, the impacting piston 12 may slide in a cup-shaped piston, wherein the exciter piston closes the hollow space of the pneumatic chamber in the radial direction, i.e., circumferentially. The pneumatic spring 13 is excited by a forced, oscillating movement along the axis 8 of the exciter piston 22. An eccentric drive 24, a wobble drive, etc., can convert the rotational movement of the motor 3 into the linear, oscillating movement. A period of the forced movement of the exciter piston 22 is coordinated with the interplay of the system of the impacting piston 12, pneumatic spring 13 and striker 20 and their relative axial distances, in particular a predetermined impact point 25 of the impacting piston 12 with the striker 20 in order to excite the system resonantly and thus optimally for energy transmission from the motor 3 to the impacting piston 12.

The striker 20 is a body, preferably a rotating body, with a front impact surface 26 exposed in the impact direction 9 and a rear impact surface 27 exposed against the impact direction 9. The striker 20 transmits an impact on its rear impact surface 27 to the tool 7 adjacent to its front impact surface 26. In terms of its function, the striker 20 may also be designated as an intermediate striking device.

A guide 28 guides the striker 20 along the axis 8. In the depicted example', the striker 20 dips partially with a rear end into a rear guide section 29. The rear end is adjacent with its radial outer surface to the guide section 29 in the radial direction. A forward guide section 30 can likewise enclose a forward end of the striker 20 and restrict its radial movement. The rear and forward guide sections 29, 30 together form two limit stops, which limit an axial movement of the striker 20 on a path between the rear limit stop 29 and the forward limit stop 30 situated in the impact direction 9 (striker limit stop). The striker 20 has a thickened center section 33, whose face surfaces strike against the axial surfaces of the guide sections 29, 30. The guide 28 depicted exemplarily has a, for example, cylindrical, circumferentially closed guide tube 31, in which is the striker 20. The thicker section 33 of the striker 20 is spaced apart radially with its lateral surface 34, i.e., radial outer surface, at least in sections or along its entire circumference from an inner wall 32 of the guide tube 31. A channel-like or cylindrical gap 35 between the striker 20 and the guide tube 31 runs over the entire axial length of the center thickened section 33. The gap 35 may have a radial dimension of between 0.5 mm and 4 mm for example.

Figure 2:
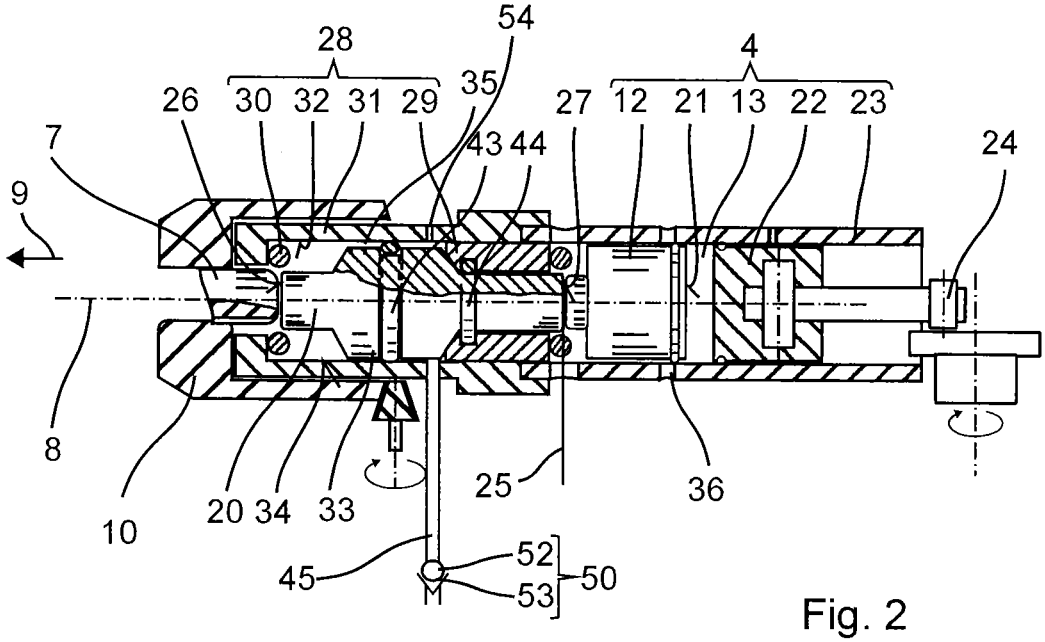
FIG. 2 illustrates the pneumatic striking mechanism in the operating position.

During chiseling, the tool 7 supports itself on the forward impact surface 26 of the striker 20, whereby the striker 20 is kept engaged on the rear limit stop 29 (FIG. 2). The striking mechanism 4 is designed for the engaged position of the striker 20. The predetermined impact point 25 (FIG. 2) of the impacting piston 12 and the reversal point in the movement of the impacting piston 12 is determined by the rear impact surface 27 of the engaged striker 20.

As soon as a user removes the tool 7 from the workpiece, the impacting function of the pneumatic striking mechanism 4 is supposed to be interrupted, because otherwise the hammer drill 1 will idle percussively. When the impacting piston 12 impacts the striker 20, the striker 20 slides to the forward limit stop 30 and preferably stands still in its vicinity. The impacting piston 12 may move forward beyond the predetermined impact point 25 in the impact direction 9 up to the preferably dampening limit stop 30. In the advanced position beyond the impact point 25, the impacting piston 12 frees a ventilation opening 36 in the impact tube 23, through which the pneumatic chamber of the excited pneumatic spring 13 is connected and ventilated with preferably the environment in the machine housing 2. The effect of the pneumatic spring 13 is reduced or reversed, which is why the impacting piston 12 stands still because of the weakened or missing connection to the exciter piston 22. The striking mechanism 4 is reactivated, if the striker 20 is engaged up to the rear limit stop 29 and the impacting piston 12 closes the ventilation opening 36.

So that the striker 20 remains preferably in the vicinity of the forward limit stop 30 after an empty impact, the striker 20 can essentially move unchecked in the impact direction 9 to the forward limit stop 30; in the opposite direction from the rear limit stop 29, the movement occurs, however, against a spring force of at least one pneumatic spring 40. The spring force of the pneumatic spring 40 is controlled as a function of the movement direction of the striker 20 related to the guide 28.

An at least partially radially running surface of the striker 20 and an at least partially radially running surface of the guide 28 form inner surfaces of the pneumatic chamber 40, which are oriented perpendicularly or inclined to the axis 8. An axial distance of the two radially running surfaces changes with the movement of the striker 20 and therefore the volume of the pneumatic chamber 40. The change in volume causes a change in the pressure within the pneumatic chamber 40.

A rear bounce surface 41 of the thicker section 33 that points opposite from the impact direction 9 can form the first radially running inner surface of the pneumatic chamber 40. A rear bounce surface 42 of the guide 28 pointing in the impact direction 9, which together with the rear bounce surface 41 of the thicker section 33 defines the rear limit stop 29, can be the second radially running inner surface of the pneumatic chamber 40.

In the radial direction, the pneumatic chamber 40 is closed on one side by the guide 28 and on the other side by the striker 20. A hermetic air-tight seal between the striker 20 and the guide 28 is realized by a first sealing element 43 and a second sealing element 44. The sealing elements 43, 44 are arranged offset from one another along the axis 8. The first sealing element 43 is arranged for example between the two limit stops 29, 30, and the second sealing element 44 is arranged axially outside of the two limit stops 29, 30, i.e., of the respective bounce surface 42. Located between the two sealing elements 43, 44 are the radially running inner surfaces of the pneumatic chamber 40. In the depicted embodiment, the sealing elements 43, 44 are arranged on sections of the striker 20 having different cross-sections, whereby the distances of the sealing elements 43, 44 to the axis 8 are different sizes. In other embodiments, at least sections of the sealing elements 43, 44 are at different distances from the axis 8. In a projection onto a plane perpendicular to the axis 8, the two seals do not overlap or at least not in sections.

The dependence of the pneumatic spring 40 on the movement direction of the striker 20 is achieved in that at least one of the sealing elements 43, 44 is configured as a valve 50. An air channel 45 links the pneumatic chamber 40 to an air reservoir in the environment, e.g., the machine housing 2. The valve 50, which controls an air flow through the channel 45, is arranged in the channel 45. Control takes place as a function of the movement of the striker 20. When the striker 20 moves in the impact direction 9, the valve 50 opens and air can flow in from the reservoir through the channel 45 into the enlarging volume of the pneumatic chamber 40; the pneumatic spring is herewith deactivated. The valve 50 blocks the channel 45 when the striker 20 moves against the impact direction 9. The pressure in the pneumatic chamber 40 rises with the reducing volume of the pneumatic chamber 40, whereby the pneumatic spring 40 works against the movement of the striker 20.

In one embodiment, the valve 50 is configured as an automatic valve or a valve 50 actuated by its own medium, e.g., a check valve or a throttle check valve. The valve 50 is actuated by an air flow, which flows into the valve 50. The air flow is a result of the pressure difference between the pneumatic chamber 40 and the space 51 connected to it via the valve 50. The connected space 51 may be a very large air reservoir, e.g., the environment, the inside of the machine housing 51, or another closed, pneumatic chamber with a limited volume.

In the depicted embodiment, the pneumatic spring 40 presses a sealing closure body 52 of the valve 50 against a valve opening 53 or valve seat of the valve 50, thereby hermetically closing the valve opening 53. When the pressure within the space 51 linked by the valve 50 overcomes the pneumatic spring 40, i.e., exceeds the pressure within the pneumatic chamber 40, the closure body 52 is pressed away from the valve opening 53. Air can flow through the valve opening 53 along the air channel 45 into the pneumatic chamber 40.

A throttle opening 54 can ventilate the pneumatic chamber 40. The throttle opening 54 can be a borehole through the wall of the guide tube 31 for example. The surface of a flow cross-section (hydraulic cross-section) of the throttle opening 54 is smaller by at least two orders of magnitude than the annular cross-sectional area of the pneumatic chamber 40, e.g., less than 0.5 percent. The throttle opening 54 is for example greater than 1/2000 or 1/1500 of the annular cross-sectional area in order to make a manual insertion of the striker 20 possible. The flow cross-section or the cross-sectional area of the throttle opening 54 is determined at its narrowest point perpendicular to the flow direction. With the movement of the striker 20, the volume of the pneumatic chamber 40 changes proportionally to the speed of the striker 20 and to the annular cross-sectional area of the volume enclosed by the pneumatic chamber 40. If the throttle 54 is supposed to equalize the volume change without a pressure change, the displaced air must pass through the throttle 54 at a speed that is at least a hundred times the speed of the striker. The flow characteristics of air set an upper limit for the flow speed, which is why a pressure equalization is possible with a slow moving but not with a rapidly moving striker 20.

The speed of the striker 20 in the impact direction 9 is approximately in the range of 1 m/s to 10 m/s in the case of an empty impact. The volume of the pneumatic chamber 40 increases correspondingly rapidly. Air flows through the opened valve 50 into the pneumatic chamber 40 at a high rate so that a pressure equalization quickly adjusts. In its opened position, the valve 50 frees a surface than can be flowed through (hydraulic surface) for this, which is at least 1/30, preferably at least 1/20, or at least 10% of the annular, effective cross-sectional area of the volume of the pneumatic chamber 40. The hydraulic surface is defined perpendicular to the flow direction in the valve 50. The effective cross-sectional area is the differential of the volume in the movement direction, i.e., the change in the volume is determined from the product of the effective cross-sectional area and the longitudinal displacement of the striker 20. When the striker 20 is reflected on the striker limit stop 30, its speed against the impact direction 9 can be in the same order of magnitude. The valve 50 closes and the compression of the closed pneumatic chamber 40 brakes the striker 20. The throttle opening 54 allows only a low airflow to escape, thereby maintaining the overpressure in the pneumatic chamber 40.

In the case of a slow movement of less than 0.2 m/s against the impact direction 9, typical for a new application of the chisel, the air may escape through the throttle opening 54 at a rate adequate to facilitate a pressure equalization. As an alternative to a separate throttle opening 54, the valve 50 may be designed as a throttle valve, which leaves open an appropriate throttle opening in a closed/throttling position.

Figure 3:
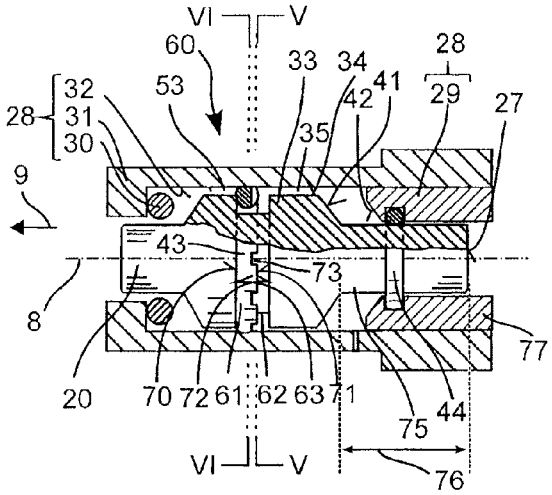
FIG. 3 illustrates the striker brake with a chamber and the moved valve in the braking position.
Figure 5:
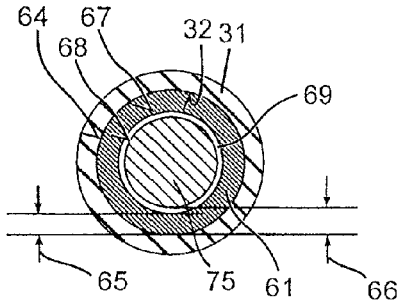
FIGS. 5 and 6 are cross-sections of planes V-V and VI-VI of FIG. 3 and FIG. 4.
Figure 4:
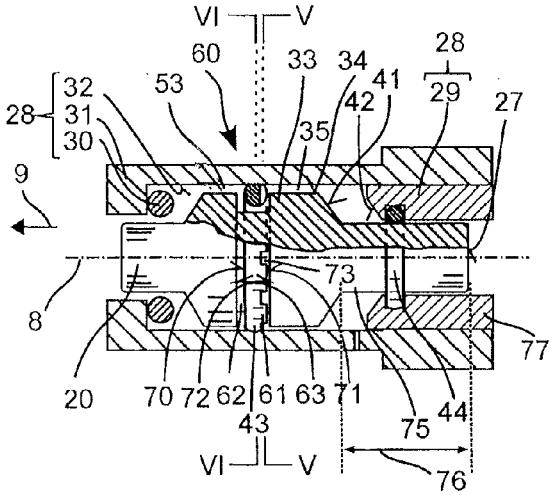
FIG. 4 is the striker brake from FIG. 4 in the released position.
Figure 6:
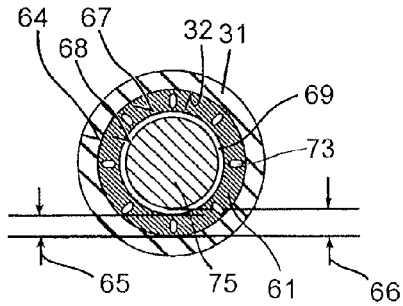

FIG. 3 and FIG. 4 show an exemplary embodiment with a valve 60 in a closed or open state. FIG. 5 and FIG. 6 are cross-sections through the valve 60 of planes V-V or VI-VI. The valve 60 has as the closure body 52 a sealing ring 61, i.e., an annular sealing element, which is inserted into a circumferentially running groove 62 in the thicker section 33 of the striker 20. The gap 35 between the striker 20 and guide tube 31 is divided by the sealing ring 61 and the groove 62 into two sections along the axis 8, which corresponds to the air channel 45 divided by the valve 50. Depending upon the position of the sealing ring 61, air can flow along the gap 35. The sealable valve opening is defined by a seat for the sealing ring 61 in the region of a forward groove wall 63 of the groove 62, i.e., situated in the impact direction 9.

The sealing ring 61 is, for example, an elastic O-ring made of natural or synthetic rubber. A surface pointing radially outwardly, called the radial outer surface 64 of the sealing ring 61 in the following, consistently abuts the inner wall 32 of the guide tube 31 along the entire circumference of the sealing ring 61 so that the sealing ring 61 and the guide tube 31 are hermetically sealed together. The sealing ring 61 may be used in the guide tube 31 in a radially pre-tensioned manner in order to support the airtight seal. A thickness 65 of the sealing ring 61, i.e., a difference from the outer radius to the inner radius, is preferably less than a depth 66 of the groove 62. A surface pointing radially inwardly, called the radial inner surface 67 of the sealing ring 61 in the following, is spaced apart in the radial direction from a groove base 68 of the groove 62 at least in a section along the circumference of the thicker section 33. Situated between the groove base 68 and the sealing ring 61 is a gap 69, through which air may flow along the axis 8.

In the closed or hermetically sealed state of the valve 60, the sealing ring 61 is adjacent with a forward face side 70, i.e., pointing in the impact direction 9, to the forward groove wall 63 of the groove 62 (FIG. 3). The forward groove wall 63 and the forward face side 70 touch each other at least along an annular closed line around the axis 8. The forward face side 70 may be flattened for example in order to terminate on a surface of the groove wall 63 with the same inclination, e.g., perpendicular, to the axis 8. A hermetic seal of the valve 60 is produced by the pairwise hermetic sealing of the sealing ring 61 with the groove wall 63, i.e., with the striker 20, or with the guide tube 31, i.e., with the guide 28. The movement of the striker 20 against the impact direction 9 stabilizes the valve 60 in the closed state. In the pneumatic chamber 40 closed by the valve 60, the pressure increases as compared with the environment, thereby pressing the sealing ring 61 against the forward groove wall 63.

In the opened state, the sealing ring 61 is adjacent with a rear face side 71, i.e., pointing against the impact direction 9, to the rear groove wall 72 of groove 62 (FIG. 4). A distance of the forward groove wall 63 to the rear groove wall 72 is dimensioned in such a way that the sealing ring 61 disengages from the forward groove wall 63 at least in sections along the circumference, when the sealing ring 61 is adjacent to the rear groove wall 72. For example, the distance between the groove walls is greater than a dimension of the sealing ring 61 along the axis 8. The sealing ring 61 moves along the axis 8 from the forward groove wall 63 to the rear groove wall 72.

The rear groove wall 72 and/or the rear face side 70 of the sealing ring 61 are structured in such a way that a contact surface along which they touch is interrupted by at least one continuous channel lying in the contact surface from the groove base 68 to the guide tube 31. For example, one or more radially running narrow channels 73 are provided in the rear face side 71. The sealing ring 61 touches the rear groove wall 72 only in sections along the circumference and air can flow through the narrow channels 73. A channel through the open valve 60 therefore runs along the forward face side 72, the radial inner surface 67 and the narrow channels 73. The movement of the striker 20 in the impact direction 9 stabilizes the valve 60 in the open state. In the pneumatic chamber 40, the pressure drops below the ambient pressure, e.g., in the space 51, and the pressure gradient causes air to flow in and press the sealing ring 61 on the rear groove wall 72. As an alternative or addition to the narrow channels 73 in the sealing ring 61, radially running narrow channels may be embedded in the rear groove wall 72. The air may flow along these narrow channels, and bridges between the narrow channels prevent the narrow channels from being sealed by the sealing ring 61.

The rear face side 71 may have other structures instead of narrow channels 73, which define channels from the radial inner surface 67 to the radial outer surface 64. The channels may run strictly radially or in addition partially along the circumference of the sealing ring 61. For example, rigid knobs may be provided which maintain the channels against the forces occurring with a forward movement of the striker 20.

Figure 7:
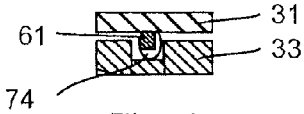
FIG. 7 is a detailed view of FIG. 4.

The sealing ring 61 may have narrow channels 74 on one of its radial inner surfaces (FIG. 7). This makes it possible to use a sealing ring 61 adjacent to the groove base.

In one embodiment, the sealing ring 61 has a throttling effect when the forward face side 70 is adjacent to the forward groove wall 63. A low air flow can flow through between the face side 70 and the forward groove wall 63. Thin radial channels may be introduced in the forward face side 70 for this. The effective total cross-sectional area of the channels is less than the effective total cross-sectional area of the channels 73 in the rear face side 71. A cross-sectional area perpendicular to the air flow of the thin channels is restricted to a maximum of one hundredth of all perpendicular cross-sectional areas of the narrow channels 73 added up over all narrow channels 73 to be the air flow.

The first sealing element 43 in the embodiment is realized by the valve 60 moved between the limit stops 29, 30. The second sealing element 44 is arranged axially offset from the rear limit stop 29 against the impact direction 9 and for example is mounted in a stationary manner in the guide 28. The second sealing element 44 is preferably configured to be annular, e.g., as an O-ring made of rubber. The striker 20 has a cylindrical rear section 75, which is guided through the second sealing element 44 consistent with its inner radial surface. The length 76 of the rear cylindrical section 75 is preferably dimensioned in such a way that at least one portion of the rear section 75 sticks into the second sealing element 44 when the striker 20 is adjacent to the forward limit stop 30 in order to hermetically seal the pneumatic chamber 40 in every position of the striker 20. The length 76 of the rear section 75 is at least longer than the path of the striker 20 between the forward limit stop 30 and the rear limit stop 29.

The second sealing element 44 may be inserted for example in a cylindrical sleeve 77, which is the introduced into the guide tube 31. The forward face sides of the sleeve 77 may form the limit stop surfaces 42 for the rear limit stop 29. The cross-sectional area of the sleeve 77 may essentially determine the cross-sectional area of the pneumatic chamber 40. The second sealing element 44 may alternatively be fastened on the rear section 75 of the striker 20, e.g., in an annular groove. The sleeve 77 is provided with a preferably smooth cylindrical inner wall along which the second sealing element 44 slides.

A diameter of the rear section 75 is less than a diameter of the thicker section 33, whereby the valve device 60 is arranged at a greater distance from the axis 8 than the second sealing element 44.

The forward groove wall 70 may be inclined with respect to the axis 8, e.g., by between 45 degrees and 70 degrees. The inclined groove wall 70 can spread the sealing ring 61 in order to support a tight fit on the forward groove wall 70.

Figure 8:
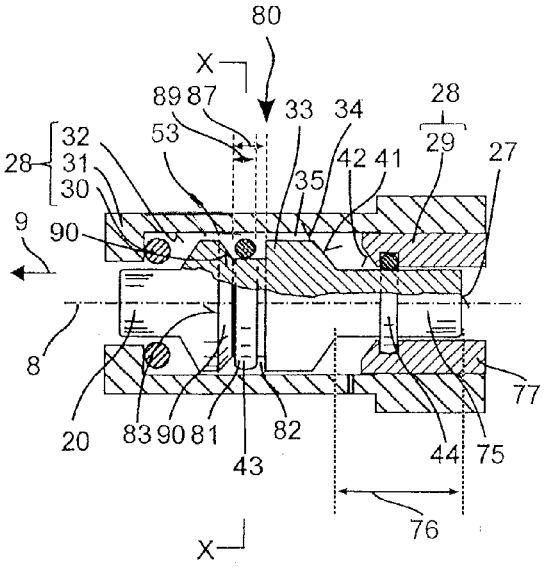
FIGS. 8 to 11 show a striker brake with one chamber.
Figure 10:
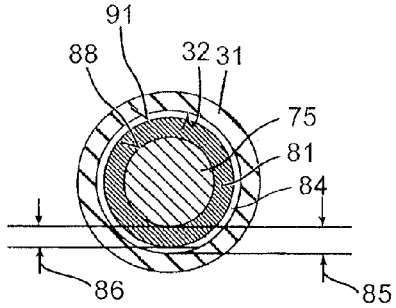
Figure 9:
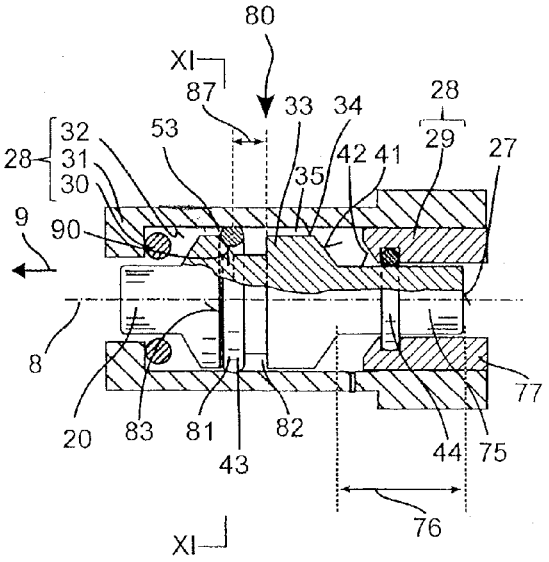
Figure 11:
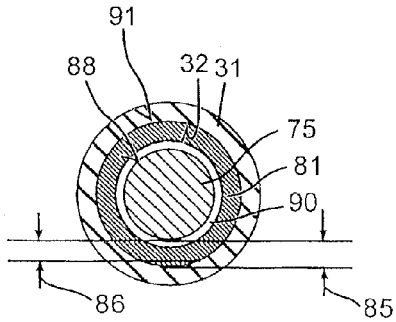

FIG. 8 and FIG. 9 show an exemplary embodiment with a valve 80 in a closed or open state. FIG. 10 and FIG. 11 are cross-sections through the valve 80 of planes X-X or XI-XI. The valve 80 has as the closure body a sealing ring 81, which is inserted into a circumferentially running groove 82 in the thicker section 33 of the striker 20. The gap 35 between the striker 20 and guide tube 31 forms the channel 45, which is divided by the groove 82 and the sealing ring 81 along the axis 8. In the region of a forward groove wall 84 of the groove 82, the sealing ring 81 can seal the channel 45.

The groove 82 can accommodate the sealing ring 81 in such a way that the sealing ring 81 is spaced apart from the inner wall 32 of the guide tube 31 (FIG. 8), i.e., there is an air gap 84 between the sealing ring 81 and the guide tube 31. To this end, a depth 85 of the groove 82 may be at least as great as a thickness 86 of the sealing ring 81. A length 87 of a groove base 88 may be selected to be at least as great as a length 89 of the sealing ring 81 along the axis 8. The groove base 88 essentially runs parallel to the axis 8 and is cylindrical. Air may flow in along the gap 35 into the pneumatic chamber 40.

A forward groove wall 90 is inclined with respect to the axis 8 and preferably defines a conical surface whose radius increases in the impact direction 9. In a closed state of the valve 80, the sealing ring 81 is slid onto to the conical forward groove wall 90. The sealing ring 81 in this case is spread radially and its outside diameter increases at least enough that the radial outer surface 91 of the sealing ring 81 touches the inner wall 32 of the guide tube 31 (FIG. 9). A hermetic seal is produced between the striker 20 and the guide 28 by its pairwise, hermetically sealing contact with the sealing ring 81.

The pressure conditions with a backward movement of the striker 20 push the sealing ring 81 onto the conical forward groove wall 90 and thereby cause the valve 80 to close automatically. In the case of a forward movement, the sealing ring 81 disengages from the conical forward groove wall 90, relaxes into its basic form with a smaller outside diameter and releases the air gap 84 to open the valve 80.

The sealing ring 81 is, for example, an elastic O-ring made of natural or synthetic rubber. The sealing ring 81 may be formed to be symmetrical to a plane perpendicular to the axis 8, i.e., having identical face sides.

The second sealing element 44 may be arranged axially offset from the rear limit stop 29 against the impact direction 9 and for example may be a sealing ring mounted in a stationary manner in the guide 28. Alternatively, the second sealing element 44 may be mounted on the rear section 75 of the striker 20.

Figure 12:
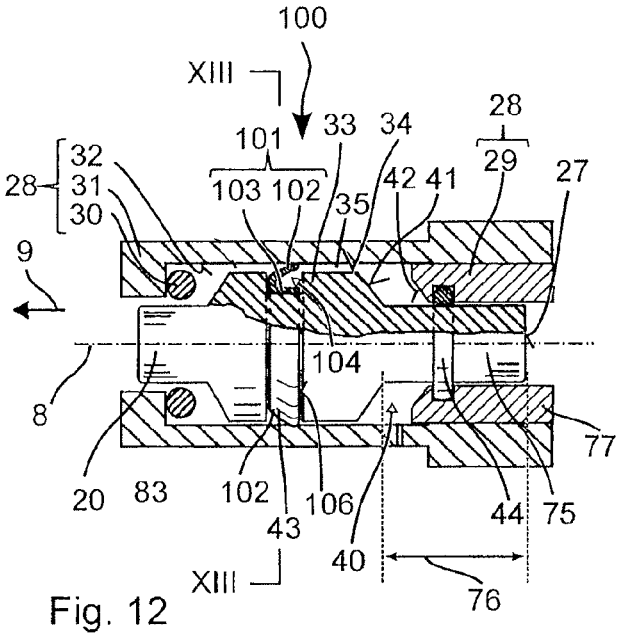
FIGS. 12 and 13 show a striker brake with one chamber.
Figure 13:
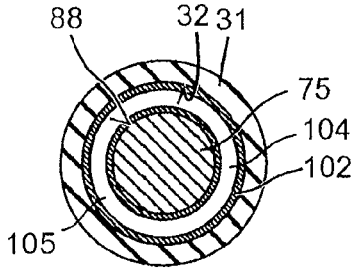

FIG. 12 and FIG. 13 show an exemplary embodiment with a valve 100 in a longitudinal section or in cross-section of plane XIII-XIII. A sealing element 101 of the valve 100 has a swivelable lip 102, which is adjacent to an inner wall 32 of the guide tube 31. A fastening section 103 of the sealing element 101 fastens the lip 102 to the thicker section 33 of the striker 20. The lip 102 is preferably elastically pre-tensioned in such a way that it is pressed on the inner wall 32 to close the valve 100. The depicted lip 102 is inclined with respect to the axis 8 and runs against the impact direction 8 from the striker 20 to the inner wall 32. The lip 102 encloses with the striker 20 a space 104 open only in the direction of the rear pneumatic chamber. Air flowing out of the rear pneumatic chamber accumulates in the half-opened space 104 and presses the lip 102 on the guide tube 31. The valve 100 stabilizes in its closed position. An airflow flowing against the impact direction 9 swivels the lip 102 in the half-opened space 104, thereby disengaging the lip from the guide tube 31. The air flow may pass through the opened valve 100.

The exemplary sealing element 101 for example may be a pneumatic piston sealing ring or a lip seal ring made of a natural or synthetic rubber. A tubular, cylindrical section of the sealing element 101 serves as a fastening section 103 in order to fasten the sealing element 101 on the thicker section 33. In the exemplary embodiment, an annular groove is introduced in the striker 20 on whose groove base 88 the fastening section 103 abuts. The lip 102 is formed by a hollow-cone-shaped section, which is attached in the radial direction to the fastening section 103 and expands against the impact direction 9. In the impact direction 9, the lip 102 veers away from the fastening section 103 in the radial direction and therefore also from the striker 20, whereby an air gap 104 forms. A face side 106 pointing against the impact direction 9 is structured with an annular indentation 105, which is limited in the radial direction by the lip 102 or the fastening section 103. The indentation 105 may have a trapezoidal, rectangular or other depth profile. In a section that is longitudinal to the axis 8, the sealing element 101 has a V-shaped or U-shaped profile, which is closed in the impact direction 9.

The dimensions and the modulus of elasticity of the lip 102 are coordinated in such a way that the lip 102 may be deformed by an adjacent air pressure. A wall thickness of the hollow cone is considerably less than a dimension of the lip 102 along the axis 8. A swiveling or folding movement of the lip 102 may occur in the impact direction 9 away from the striker 20 or against the impact direction 9 toward the striker 20. A region in which the lip 102 is fastened to the striker 20, i.e., immovable in the radial direction, is situated in the impact direction 9 offset from a region in which the lip 102 is adjacent to the guide tube 31.

The lip 102 may have a region with a reduced wall thickness, which serves as a solid-body joint. Furthermore, the fastening section 103 may have a joint in which the lip 102 is rotatably mounted around an axis. The lip 102 is preferably fabricated of an elastic material with a low wall thickness such that a pressure gradient between the pneumatic chamber 40 bends the lip and therefore it can disengage from the inner wall 32.

In another embodiment, the sealing element 101 is anchored in the inner wall and the lip 102 touches the striker 20.

The second sealing element 44 may be arranged axially offset from the rear limit stop 29 against the impact direction 9 and for example may be a sealing ring mounted in a stationary manner in the guide 28.

Figure 14:
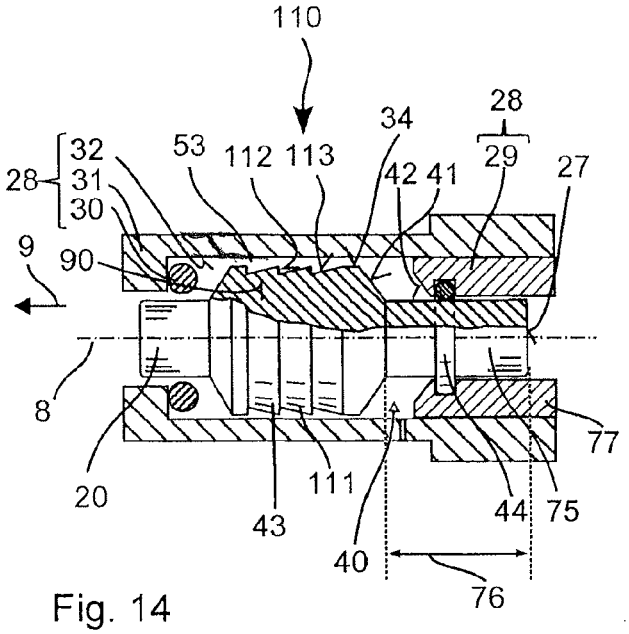
FIG. 14 shows a striker brake with one chamber.

FIG. 14 shows an exemplary embodiment with a valve 110 in a longitudinal section. The valve 110 does not have a physical closure body, rather uses the flow behavior of the air to achieve a barrier effect for an air flow in the impact direction 9 and a pass-through effect for an air flow against the impact direction 9.

The lateral area 34 of the thicker section 33 of the striker 20 is structured with several circumferential grooves 111 arranged axially offset from one another. The grooves 111 each have a forward groove wall 112 and a rear groove wall 113. The rear groove wall 113 is inclined with respect to the axis 8, and runs radially outwardly against the impact direction 9. The rear inclination angle related to the axis 8 may be for example between 10 degrees and 60 degrees. The forward groove wall 112 on the other hand runs essentially perpendicular to the axis 8 or may be inclined between 80 degrees and 100 degrees to the axis 8. A radial depth of the grooves 111 is small, for example in a range of 0.5 mm to 2 mm. In the case of a backward movement of the striker 20, inflowing air ricochets off the rigid forward groove walls 112 and forms turbulence in the grooves 111. The flow speed is reduced by several orders of magnitude. In the case of a forward movement of the striker 20, inflowing air is gently deflected by the flat rear groove walls 113, whereby the flow speed is only negligibly affected.

The second sealing element 44 may be arranged axially offset from the rear limit stop 29 against the impact direction 9 and for example may be a sealing ring mounted in a stationary manner in the guide 28.

Figure 15:
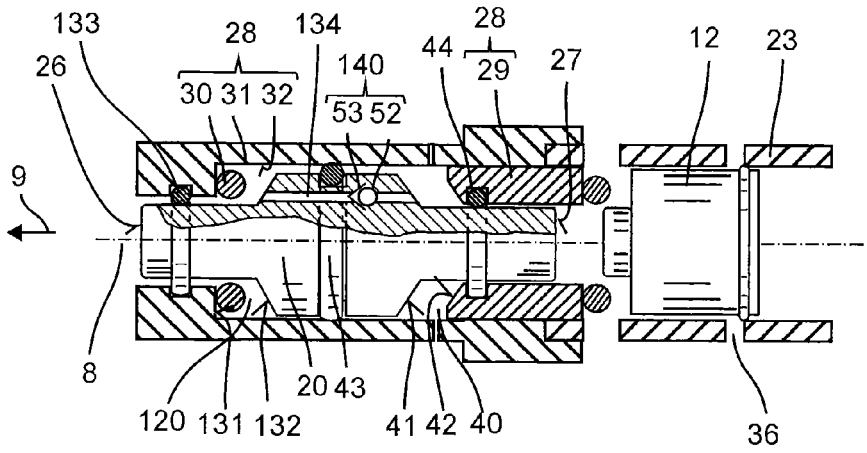
FIG. 15 shows a striker brake with two chambers.

FIG. 15 shows a longitudinal section of another embodiment with a rear pneumatic spring 40, a forward pneumatic spring 120 and at least one valve 140 for controlling the behavior of the striker 20. The spring force of the rear pneumatic spring 40 and the forward pneumatic spring 120 is controlled as a function of the movement direction of the striker 20. Whereas, in the case of a forward movement, i.e., in the impact direction 9, of the striker 20, the pneumatic springs 40, 120 are deactivated or weak, the pneumatic springs 40, 120 jointly decelerate a backward movement of the striker 20. The spring force of the pneumatic springs 40, 120 may be different; the pressure-loaded rear pneumatic spring 40 can develop a greater decelerating effect than the forward pneumatic spring 120.

The forward pneumatic chamber 120 of the forward pneumatic spring has a forward inner wall 131 running at least partially radially, which is formed by the guide 28, and a rear inner wall 132 running at least partially radially, which is formed by the striker 20. The rear pneumatic chamber 40 of the rear pneumatic spring has a forward inner wall 41 running at least partially radially, which is formed by the striker 20, and a rear inner wall 42 running at least partially radially, which is formed by the guide 28. In the radial outward direction, the pneumatic chambers 40, 120 are closed by the inner wall 32 of the cylindrical or prismatic guide tube 31. In the radial inward direction, the pneumatic chambers 40, 120 are closed by striker 20. A first sealing element 43 and a second sealing element 44 are arranged axially offset from one another in the radial gap 35 for the sliding movement of the striker 20 in the guide 28 in order to seal the rear pneumatic chamber 40 in an air-tight manner. The forward and rear inner walls 41, 42 of the rear pneumatic chamber 40 are arranged along the axis 8 between the first sealing element 43 and the second sealing element 44. A third sealing element 133 is arranged in the impact direction 9 in front of the forward inner wall 131 of the forward pneumatic chamber 120. The forward and the rear inner walls 131, 132 of the forward pneumatic chamber 120 are situated along the axis 8 within the first sealing element 43 and the third sealing element 133.

The two pneumatic chambers 40, 120 are connected to one another via an air channel 134, in which a valve 140 is arranged. The valve 140 is blocked for an air flow out of the rear pneumatic chamber 40 into the forward pneumatic chamber 120 and can be flowed through for an air flow out of the forward pneumatic chamber 120 into the rear pneumatic chamber 40. A barrier element 52 can be pushed through an air flow from the rear pneumatic chamber 40 into a valve opening 53 and thereby close the valve 140, an air flow in the opposite direction lifts the barrier element 52 off of the valve opening 53 and opens the valve 140.

In the case of a forward movement, i.e., in the impact direction 9, of the striker 20, the volume of the rear pneumatic chamber 40 increases and the volume of the forward pneumatic chamber 120 decreases. The displaced air volume in the forward pneumatic chamber 120 may flow through the valve 140 into the rear pneumatic chamber 40. In the case of a backward movement, i.e., against the impact direction 9 of the striker 20, the volume of the forward pneumatic chamber 120 increases and the volume of the rear pneumatic chamber 40 decreases. The valve 140 prevents an air flow, which would equalize the increased pressure in the rear pneumatic chamber 40 and the reduced pressure in the forward pneumatic chamber 120. The backward movement therefore takes place against the spring force of the two pneumatic springs 40 and 120 and is decelerated.

The air channel 134 may run completely within the guide 28. The air channel 134 is preferably closed in such a way that the entire air quantity displaced from the forward pneumatic chamber 120 is discharged into the rear pneumatic chamber 40. The forward and rear pneumatic chambers 40, 120 coupled via the channel 134 have a constant air volume that is closed from the environment, wherein a distribution of the air volume to the two chambers 40, 120 varies as a function of the momentary position of the striker 20.

Figure 16:
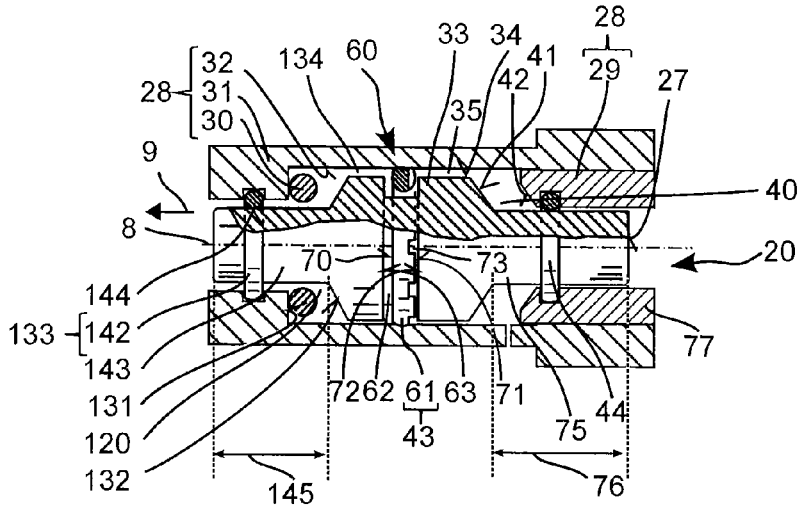
FIG. 16 shows a striker brake with two chambers.

FIG. 16 shows an embodiment with the valve 60, which pneumatically couples the forward pneumatic chamber 120 and the rear pneumatic chamber 40. Reference is made to the embodiments in connection with the valve 60 for a description of the elements, particularly those related to the rear pneumatic chamber 40. The air channel 134 between the two pneumatic chambers 40, 120 is completely arranged within the guide 28.

A forward bounce surface of the thicker section 33 of the striker 20 forms the rear inner wall 132 of the forward pneumatic chamber 120 and the rear bounce surface of the thicker section 33 forms the forward inner wall 41 of the rear pneumatic chamber 40. The forward inner wall 131 of the forward pneumatic chamber 120 may be formed by a region of the guide 28 defining the forward limit stop 30. An elastic damping element 30 made of rubber, e.g., an O-ring, may also be arranged in the forward pneumatic chamber 120, which damping element softens an impact of the striker 20 in the forward limit stop 30. Projections of the two inner walls 131, 132 of the forward pneumatic chamber 120 onto a plane perpendicular to the axis 8 are essentially the same. The rear inner wall 42 of the rear pneumatic chamber 40 may be formed by a surface of the guide 28 defining the rear limit stop 29. Projections of the two inner walls 41, 42 of the rear pneumatic chamber 40 onto a plane perpendicular to the axis 8 are essentially the same. In the case of a movement of the striker 20, the axial distances between the inner walls of each of the pneumatic chambers 40, 120 change and consequently their volumes. The total of the two volumes may be constant, wherefore the surfaces of the forward inner walls projected onto the plane perpendicular to the axis 8 and the correspondingly projected surface of the rear inner walls are the same size.

The gap 35 between the striker 20 and the guide tube 31 forms the air channel 134 between the pneumatic chambers 40, 120. Narrow channels running along the axis 8 in the lateral area 34 of the thicker section 33 may form additional air channels.

The valve 60 on the thicker section 33 blocks against an air flow from the rear pneumatic chamber into the forward pneumatic chamber 120 and opens for an air flow from the forward pneumatic chamber into the rear pneumatic chamber 40. The design of the valve 60 may be taken from the foregoing descriptions.

The third sealing element may be a sealing ring 142 made of rubber, which is arranged axially offset from the forward limit stop 30 in the impact direction 9. The third sealing element 133 may be inserted for example into a groove in the guide tube 31. The striker 20 has a cylindrical, forward section 143, which is consistently guided through the third sealing element 133 with its inner radial surface 144. The length 145 of the forward cylindrical section 143 is preferably dimensioned such that at least one portion of the forward section 143 sticks in the third sealing element 133, when the striker 20 is adjacent to the rear limit stop 29 in order to hermetically seal the forward pneumatic chamber 120 in every position of the striker 20. When the striker 20 is adjacent to the forward limit stop 30, the forward section 143 projects over the third sealing element 133 in the impact direction 9 by at least a length corresponding to the path of the striker 20 between the forward limit stop 30 and the rear limit stop 29. A diameter of the forward section 143 is less than the diameter of the thicker section 33.

Figure 17:
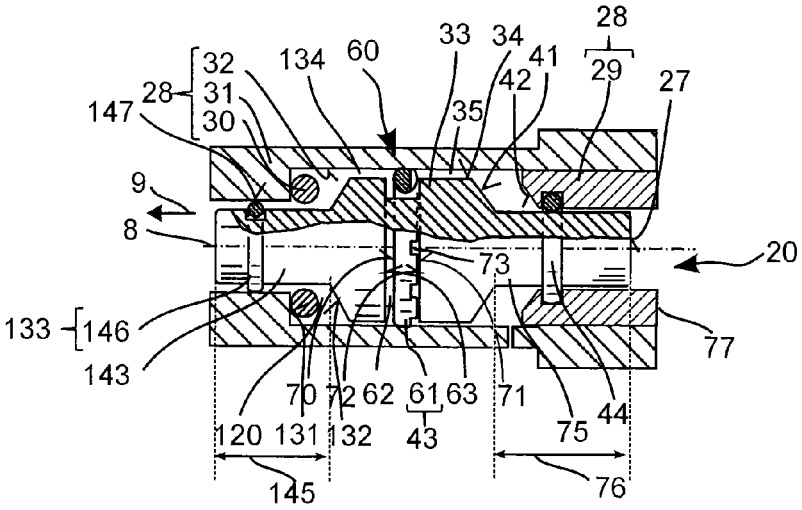
FIG. 17 shows a striker brake with two chambers.

In an alternative embodiment, a sealing ring 146 is fastened on the forward section 143 of the striker 20, e.g., in an annular groove (FIG. 17). The sealing ring 146 slides within a cylindrical sleeve 147 in the guide 28 and with it seals in every position of the striker 20. An outer radial surface of the sealing ring 146 touches the sleeve 147.

Instead of or in addition to the one-way valve 80 with an axially floating sealing ring 61, other one-way valve systems may be arranged on the thicker section 33, e.g., those described with a conical connecting member for a sealing ring 80, a flap valve 100, a gap sealing valve 110.

Figure 18:
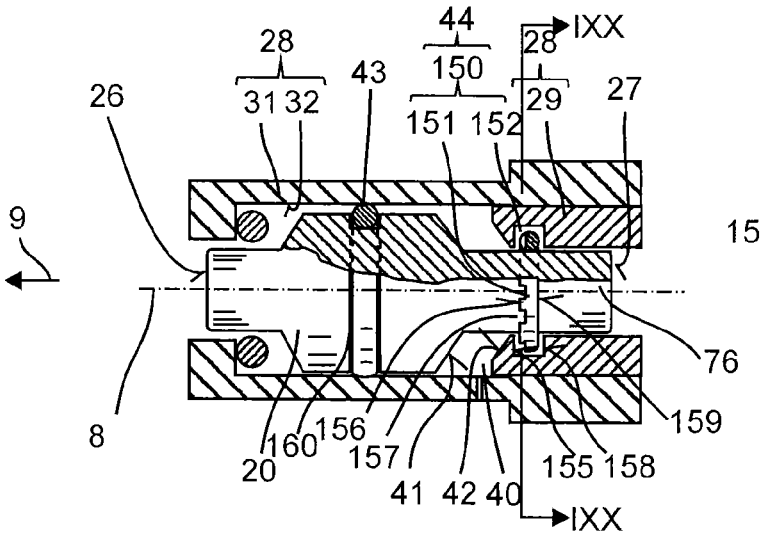
FIGS. 18 and 19 show a striker brake with a stationary valve.
Figure 19:
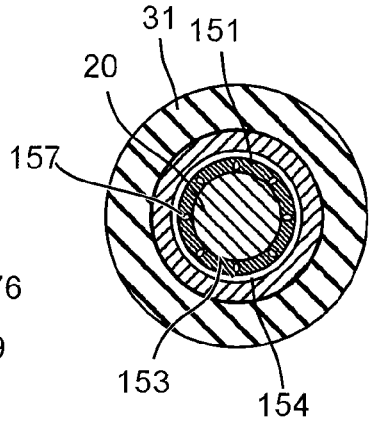

FIG. 18 and FIG. 19 show another embodiment with a valve 150 in a longitudinal section or a cross-section of plane XVIII-XVIII. The valve 150 is mounted in a stationary manner in the guide 28 and forms the second sealing element 44. The alignment of the valve 150 with respect to the impact direction 9 is altered when compared to the previous embodiments, because the valve 150 is arranged as viewed from the tool behind the pneumatic chamber 40.

The design of the valve 150 corresponds to a large extent to the design of the embodiment explained in conjunction with valve 50 embodiment. The single essential difference is the opposite orientation of the valve 150 with respect to the impact direction 9 as compared to the valve 50. Both valves 50 make it possible for air to flow into the pneumatic chamber 40 and prevent air from flowing out. The valve 150 has a sealing ring 151, which is mounted in a circumferential groove 152 in the guide 28. The sealing ring 151 encloses the rear section 75 of the striker 20 in a flush and air-tight manner. There is a gap 154 between a groove base 153 of the groove 152 and the sealing ring 151, through which gap air can flow in along the axis 8. The groove 152 is wider than the sealing ring 151 in order to make movement of the sealing ring 151 along the axis 8 possible. A forward groove wall 155 and a forward face side 156 of the sealing ring are structured in such a way that, when the sealing ring 151 is adjacent to the forward groove wall 155, radial channels 157 remain free between the sealing ring 151 and the forward groove wall 155. The channels 157 may be stamped into the forward face side 156 of the sealing ring 151 for example as narrow channels. The rear groove wall 158 of the groove 152 and the rear face side 159 of the sealing ring 151 may be hermetically sealed together along a closed circular line around the axis 8. In the case of the forward movement of the striker 20, the sealing ring 151 is pressed against the forward groove wall 155, also supported by the air flowing along the rear section 75 of the striker 20 into the pneumatic chamber 40, whereby the valve 150 is opened or kept open. In the case of a backwards movement of the striker 20, the sealing ring 151 is pressed against the rear groove wall 158, also supported by the overpressure building up in the pneumatic chamber 40, whereby the valve 150 is closed or kept closed.

The first sealing element 43 between the limits stops may be realized, for example, by a sealing ring made of rubber, e.g., an O-ring, which is inserted into an annular groove 160 in the thicker section 33 so that it cannot move. Alternatively, a valve, e.g., the valve 60 from the previous embodiment, may form the first sealing element 43.

Figure 20:
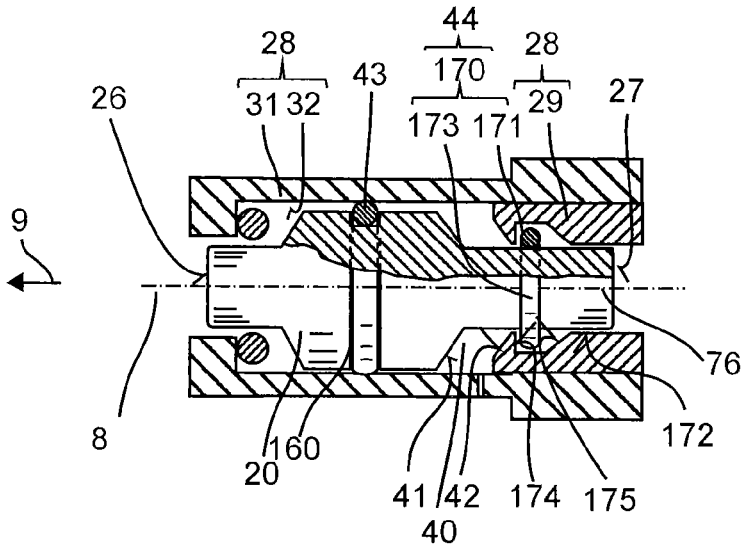
FIG. 20 shows a striker brake with a stationary valve.

FIG. 20 shows a longitudinal section of another embodiment with a valve 170 arranged in a stationary manner. The first sealing element 43 may be a sealing element that seals permanently or a valve. The valve 170 forms the second sealing element 44 by means of a groove 171, which is embedded in an inner wall 172 of the guide 28, and an annular sealing element 173, which is inserted into the groove 171, and encloses the rear section 75 of the striker 20. The groove 171 is arranged axially against the impact direction 9 of the rear limit stop 29. A forward groove wall 174 of the groove 171 is essentially perpendicular to the axis 8, while the rear groove wall 175 of the groove 171 is inclined with respect to the axis 8. The rear groove wall 175 runs radially inwardly against the impact direction 9. The valve 170 blocks when air flows out of the pneumatic chamber 40, in that the sealing ring 173 is compressed radially by the diagonal rear groove wall 175 and presses against the striker 20.

Figure 21:
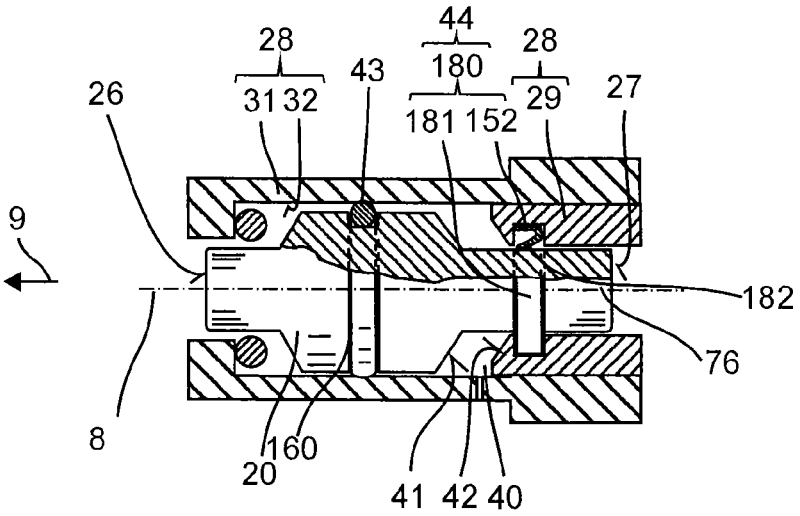
FIG. 21 shows a striker brake with a stationary valve.

FIG. 21 shows an embodiment, in which a valve 180 is mounted in the guide 28. The design of the valve 180 may correspond to that of valve 100. The valve 180 is arranged axially offset from the rear limit stop 29 of the striker 20 against the impact direction 9. A sealing ring 181 of the valve 180 has an annular lip 182, which runs radially inwardly in the impact direction 9 up to the rear section 75 of the striker 20 and touches it. The lip 182 is swivel-mounted in the guide 28 by a solid-body joint. The solid-body joint is further away from the pneumatic chamber 40 along the axis 8 than the region in which the lip 182 touches the striker 20. As a result, the lip 182 blocks against air flowing out of the pneumatic chamber 40, but makes it possible for air to flow into the pneumatic chamber 40.

The first sealing element 43 may be a sealing element that seals permanently or a valve, which is used for example in an annular groove 160 in the thicker section 33.

As an alternative (not shown), the lip may be swivel-mounted on the rear section 75 of the striker 20, wherein the lip runs radially outwardly in the impact direction 9. The lip touches a sleeve within the guide tube 31. The axial position of the lip and the length of the rear section 75 of the striker 20 are selected in such a way that the lip touches the sleeve in every position of the striker 20.

Figure 22:
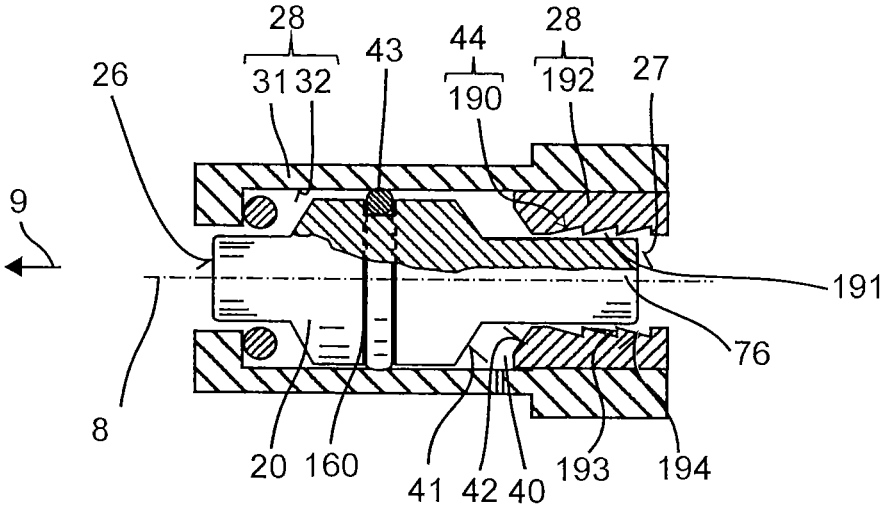
FIG. 22 shows a striker brake with a stationary valve.

FIG. 22 shows an exemplary embodiment with a valve 190 in a longitudinal section. The valve 190 may be configured analogously to the valve 110. The saw-tooth profile formed of several grooves 191 arranged along the axis 8 is formed in a sleeve 192, which is inserted into the guide tube 31. The forward groove walls 193 of the grooves 191 are inclined with respect to the axis 8, while the rear groove walls 194 run essentially perpendicular to the axis 8. Air flowing out of the pneumatic chamber 40 ricochets off the rigid rear groove walls 194, and the turbulent flow reduces the flow speed. Air flowing into the pneumatic chamber 40 from the rear section 75 of the striker 20 is only marginally impeded by the inclined forward groove walls 193. In the case of an embodiment that is not depicted, the grooves with a diagonal forward groove wall and a perpendicular rear groove wall are introduced into the rear section 75 of the striker 20. The rear section 75 slides in a cylindrical sleeve.

Figure 23:
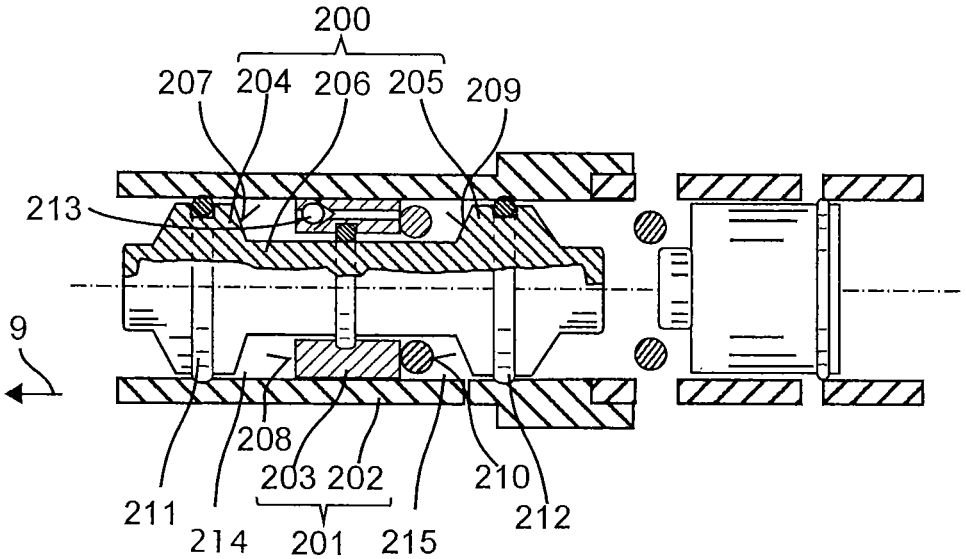
FIG. 23 shows a striker brake with a dumbbell-shaped striker.

FIG. 23 shows another embodiment with a differently designed striker 200 and an associated guide 201. The guide 201 has for example a cylindrical guide tube 202, in which the striker 200 slides. Inserted into the guide tube 202 is a sleeve 203, which locally reduces the inner cross section of the guide tube 202. The striker 200 has a tapered center section 206 along the axis 8 between a forward section 204 and a rear section 205. The forward section 204 and the rear section 205 may form the impact surfaces 26, 27. The diameter of the center section 206 is adapted to the sleeve 203. The diameters of the forward and rear sections 204, 205, which are preferably equal in size, are adapted to the larger inner diameter of the guide tube 201. The forward section 204 is after the sleeve in the impact direction 9 and the rear section 205 is in front of the sleeve 203 in the impact direction 9. A radially running surface 207 of the forward section 204 pointing against the impact direction 9 together with a surface 208 of the sleeve 203 pointing in the impact direction 9 form the rear limit stop. The forward limit stop is formed by the rear section 205 and its radially running surface 209 pointing in the impact direction 9 and the surface 210 of the sleeve 203 pointing against impact direction.

The guide 201 is connected in an air-tight manner with the forward section 204 or the rear section 205 of the striker 200 in the radial direction by a forward sealing ring 211 and a rear sealing ring 212. A one-way valve 213 is arranged in the sleeve 203, which valve can seal the sleeve 203 with respect to the center section 206 of the striker 200 depending upon the movement direction of the striker 200. A forward pneumatic chamber 214 and a rear pneumatic chamber 215 are hereby defined, which are coupled via the valve 213. As in the foregoing embodiments, the valve 213 opens in the case of a movement of the striker 200 in the impact direction 9 and closes or throttles in the case of a movement of the striker 200 against the impact direction 9. The one-way valve 213 may be for example the valve 60 with a slotted, axially floating sealing ring 61, the valve 80 with a conical connecting member for a sealing ring, the valve 100 with a flap valve, the valve 110 with a gap sealing valve.

In one embodiment, only one pneumatic chamber is provided, wherefore the forward 211 or the rear sealing ring 212 is omitted or is arranged in a non-hermetically sealed manner for example.

FIG. 24 shows a longitudinal section of an exemplary embodiment with a valve 220. The valve 220 is arranged outside the guide 28. One or more radial boreholes 221 through the wall of the guide tube 31 are arranged between the rear, second sealing element 44 and the first sealing element 43 on the thicker section 33 of the striker 20. The valve 220 is designed for example as a flap valve or check valve with a spring-mounted flap 222 in front of a first valve opening 223. The flap 222 is situated in front of the first valve opening 223, as viewed from the pneumatic chamber 40, whereby the valve 220 blocks in the case of an overpressure in the pneumatic chamber 40.

FIG. 25 shows an exemplary embodiment with a valve 230 in a longitudinal section and FIG. 26 shows an associated section of plane XXV-XXV. One or more boreholes 231 through the wall of the guide tube 31 form the valve opening. The boreholes 231 are arranged between the rear sealing element 44 and the forward sealing element 43 on the thicker section 33 of the striker 20, regardless of its position. The pneumatic chamber 40 can be ventilated through the boreholes 231. The closure body is formed by a sealing ring 232, which is adjacent to the inner wall 32 of the guide tube 31 at the axial height of the boreholes 231. The sealing ring 232, e.g., an O-ring made of rubber, may have dome-shaped knobs projecting in the radial direction, which engage in conical openings of the boreholes 231 and can seal these hermetically. In the case of an overpressure in the pneumatic chamber 40, i.e., due to the backwards movement of the striker 20, the sealing ring 232 is pressed against the boreholes 231 and seals them. In the case of an underpressure in the pneumatic chamber 40 due to a forward movement of the striker 20, the sealing ring 232 is compressed radially and air can flow into the pneumatic chamber 40.

FIG. 27 shows another embodiment, in which two pneumatic chambers 40, 120 are connected by one or two valves 240 outside of the guide 28. Both pneumatic chambers 40, 120 each have an opening, e.g., a radial borehole 241, in the guide tube 31. A preferably closed channel 242 running outside of the guide 28 connects the two pneumatic chambers 40, 120. The valve 240 is connected in the channel 242. The valve 240 for example may be a check valve or a throttle check valve, which can be flowed through in the direction of the rear pneumatic chamber 40. The outflowing air quantity from the forward chamber 120 is completely accommodated by the rear chamber.

Figure 28:
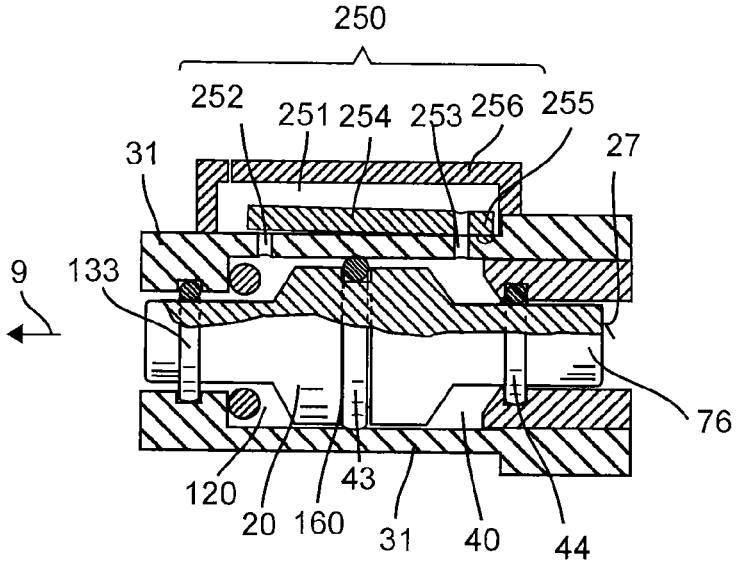
FIG. 28 shows a striker brake with an external valve.

FIG. 28 shows another embodiment with two pneumatic chambers 40, 120 and a valve 250 via which the two chambers are coupled. An air channel 251 is arranged outside the guide 28. The forward pneumatic chamber 120 and the rear pneumatic chamber 40 are each connected with the air channel 251 via a forward opening 252 or a rear opening 253, e.g., in the radial sealing guide tube 31. The rear opening 253 is preferably permanently open. Adjacent to the guide tube 31 is a lamella 254, which covers the forward opening 252 in an air-tight manner. The lamella 254 is swivel-mounted elastically or via a joint 255. An air flow out of the forward pneumatic chamber 120 can raise the lamella 254 in the region of the forward opening 252 and flow into the rear pneumatic chamber 40 through the air channel 251.

A muffle 256 can cover the forward opening 252 and rear opening 253 at the same time and laterally terminate flush with the guide 28. The air channel 251 runs inside the muffle sleeve 256. The lamella 254 may be formed for example by a tube made of rubber, which extends over the forward opening 252 and the rear opening 253. An opening can be provided in the tube in the region of the rear opening 253.

Figure 29:
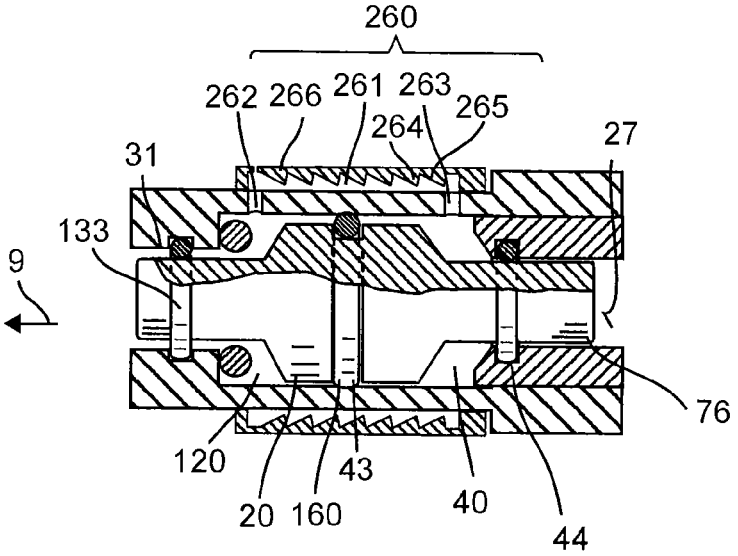
FIG. 29 show a striker brake with an external valve.

FIG. 29 depicts a further embodiment with two pneumatic chambers 40, 120 and a valve 260 via which the two chambers are coupled. An air channel 261 runs outside of the guide tube 28 and is connected via a forward opening 262 to the forward pneumatic chamber 120 and via a rear opening 263 to the rear pneumatic chamber 40. The air channel 261 has several constrictions arranged one behind the other in the longitudinal direction. The constrictions have a perpendicular facet 264 in the direction of the rear pneumatic chamber 40 and an inclined facet 265 in the direction of the forward pneumatic chamber 120. The inclined facets 265 have an angle of between 20 degrees and 60 degrees to the longitudinal direction of the air channel 261. The air channel 261 has a preferred flow direction from the forward pneumatic chamber 120 to the rear pneumatic chamber 40 and blocks in the opposite direction.

The air channel 261 may be formed by a tube 266, which is put over the guide tube 31 and the forward and rear openings 262, 263 introduced in the guide tube 31. The constrictions may be defined by a profile on the guide tube 31 and/or a profile in the tube 266.

Figure 30:
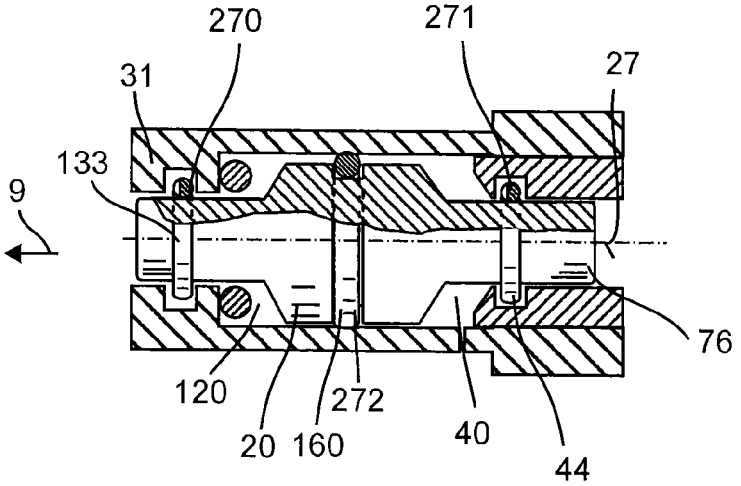
FIG. 30 shows a striker brake.

FIG. 30 shows another embodiment, in which two independent valves for two pneumatic chambers 40, 120 are provided. The pneumatic chambers 40, 120 are not coupled.

In the depicted embodiment, the forward pneumatic chamber 120 is linked to the environment via a first valve 270. The first valve 270 blocks against air flowing into the forward pneumatic chamber 120. A second valve 271 links the rear pneumatic chamber 40 to the environment and is blocked for air flowing out of the rear pneumatic chamber 40. The two pneumatic chambers 40, 120 are separated by the first sealing element in the exemplary embodiment of a sealing ring 272, which is arranged axially between the two valves 270, 271. The two valves 270, 271 may be formed for example by the depicted one-way valve 60 or by other one-way valves.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A power tool, comprising:

a striker which is guidable along an axis parallel to an impact direction;

a first pneumatic chamber defined between an exciter piston and an impacting piston, wherein the impacting piston is contactable on the striker;

a second pneumatic chamber with a volume that is variable with a movement of the striker along the axis; and a valve device associated with the second pneumatic chamber that is actuatable depending upon a movement of the striker;

wherein the valve device is actuatable to open upon a movement of the striker in the impact direction and is actuatable to throttle or close upon a movement of the striker against the impact direction;

and wherein the valve device includes a check valve.

2. The power tool according to claim 1, wherein the volume is increasable upon the movement of the striker in the impact direction.

3. The power tool according to claim 1, further comprising a third pneumatic chamber with a volume that is variable with a movement of the striker along the axis, wherein the volume of the third pneumatic chamber is decreasable upon the movement of the striker in the impact direction.

4. The power tool according to claim 3, wherein the second pneumatic chamber and the third pneumatic chamber are closed by a guide for guiding the striker along the axis and wherein three seals are arranged offset from one another along the axis between the striker and the guide.

5. The power tool according to claim 1, wherein the second pneumatic chamber is closed by a guide for guiding the striker along the axis and wherein two seals are arranged offset from one another along the axis between the striker and the guide.

6. The power tool according to claim 5, wherein an opening in the guide is arranged between the two seals.

7. The power tool according to claim 6, wherein the valve device is arranged outside of the guide.

8. The power tool according to claim 1, wherein the valve device is actuatable by an air flow into or out of the second pneumatic chamber.

9. A power tool, comprising:

a striker which is guidable along an axis parallel to an impact direction;

a first pneumatic chamber defined between an exciter piston and an impacting piston, wherein the impacting piston is contactable on the striker;

a second pneumatic chamber with a volume that is variable with a movement of the striker along the axis;

a valve device associated with the second pneumatic chamber that is actuatable depending upon a movement of the striker;

wherein the valve device is actuatable to open upon a movement of the striker in the impact direction and is actuatable to throttle or close upon a movement of the striker against the impact direction; and a third pneumatic chamber with a volume that is variable with a movement of the striker along the axis, wherein the volume of the third pneumatic chamber is decreasable upon the movement of the striker in the impact direction;

wherein the valve device connects the third pneumatic chamber with the second pneumatic chamber.

10. The power tool according to claim 9, wherein the valve device is openable for an air flow out of the third pneumatic chamber and into the second pneumatic chamber.

11. A power tool, comprising:

a striker which is guidable along an axis parallel to an impact direction;

a first pneumatic chamber defined between an exciter piston and an impacting piston, wherein the impacting piston is contactable on the striker;

a second pneumatic chamber with a volume that is variable with a movement of the striker along the axis;

a valve device associated with the second pneumatic chamber that is actuatable depending upon a movement of the striker;

wherein the valve device is actuatable to open upon a movement of the striker in the impact direction and is actuatable to throttle or close upon a movement of the striker against the impact direction; and a throttle opening associated with the second pneumatic chamber wherein an effective cross-sectional area of the second pneumatic chamber is greater than a hundred times a cross-sectional area of the throttle opening.

* * * * *